United States Patent [19]

Pollock

[11] 3,963,884

[45] June 15, 1976

[54] MINIATURE MULTIPOLE DOUBLE-THROW SLIDE SWITCH

[75] Inventor: Robert William Pollock, Manchester, N.H.

[73] Assignee: McGraw-Edison Company, Elgin, Ill.

[22] Filed: Jan. 21, 1975

[21] Appl. No.: 542,727

[52] U.S. Cl. ..... 200/16 D

[51] Int. Cl.[2] ..... H01H 15/02

[58] Field of Search ..... 200/16 R, 16 C, 16 D, 200/252, 254, 291

[56] References Cited

UNITED STATES PATENTS

| | | | |
|---|---|---|---|
| 3,485,966 | 12/1969 | Bailey et al. | 200/16 D |
| 3,502,825 | 3/1970 | Bailey et al. | 200/16 D |
| 3,643,042 | 2/1972 | Gratz | 200/16 D |
| 3,735,059 | 5/1973 | Glaser et al. | 200/16 C |
| 3,757,060 | 9/1973 | Ianuzzi et al. | 200/16 C |
| 3,818,169 | 6/1974 | Kobernus | 200/16 D X |
| 3,912,887 | 10/1975 | Gratz et al. | 200/16 D |

*Primary Examiner*—James R. Scott

[57] ABSTRACT

A miniature multipole double-throw switch designed for plug-in connection with printed circuit boards comprises a shallow, insulated housing containing a plurality of separate switches in an in-line arrangement. Each switch comprises three terminal pins having fixed in-line contacts, and a slidable switch pole shiftable linearly between the two pairs of terminal-pin contacts. The switch pole has a central bridge portion provided integrally at each end with a pair of spring blades in a V-arrangement for slidably embracing the selected pairs of fixed contacts. A slidable, insulated holder for the switch pole has a detent arm which coacts with a side wall of the housing to detent the switch in its respective positions.

3 Claims, 5 Drawing Figures

MINIATURE MULTIPOLE DOUBLE-THROW SLIDE SWITCH

The invention resides in features of single-pole, double-throw switches which lend themselves to a compact grouping into a single miniature device, and also to these and other features which enable the individual switches to be immune to shock and vibration and to have an exceptionally high current capacity and a low contact resistance. Although the invention is herein particularly shown and described in terms of a multipole, double-throw switch, no unnecessary limitation thereto is intended because the invention comprehends also single-pole, on-off and double-throw switches incorporating the novel features herein described.

An object of the invention is to provide a miniature multipole double-throw switch for printed circuitry which is within the size heretofore required for multipole single-throw switches.

Another object is to provide such miniature multipole double-throw switch which has a linearly slidable switch-pole holder provided with an integral detent arm engaging a notched side wall of the switch housing.

Another object is to provide such miniature switch which has a linearly-shiftable switch-pole member for connecting either of two sets of fixed contacts wherein the pole comprises a conductive bridge having two pairs of switch blades for slidably embracing respective contacts in each switch position to render the switch immune to shock and vibration and to provide the switch with greater current-carrying capacity and with a lesser contact resistance than has been heretofore obtained in miniature switches.

These and other objects and features of the invention will be apparent from the following description and the appended claims.

In the description of the invention, reference is had to the accompanying drawings, of which:

Figure 1:
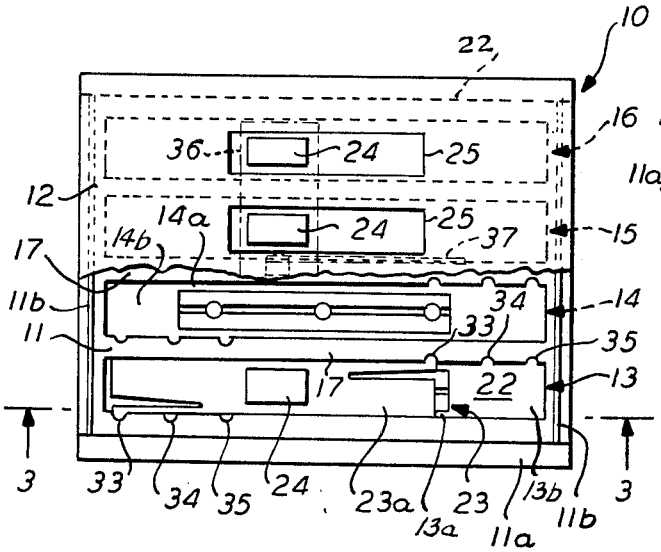
FIG. 1 is a plan view of the present multipole double-throw miniature switch with part of the housing cover broken away to show the internal construction.
Figure 2:
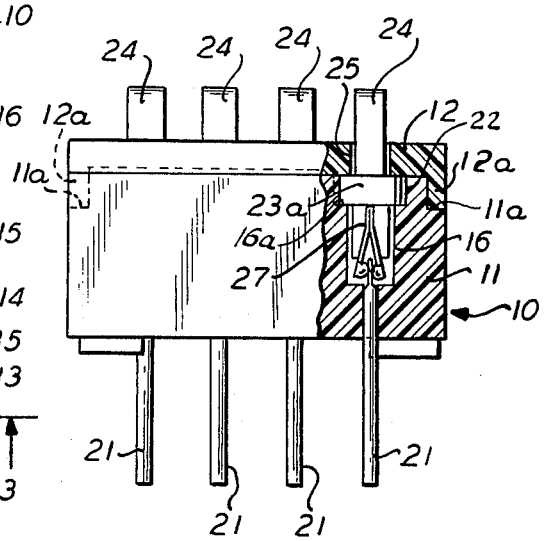
FIG. 2 is an elevational end view of this switch also partly broken away.
Figure 3:
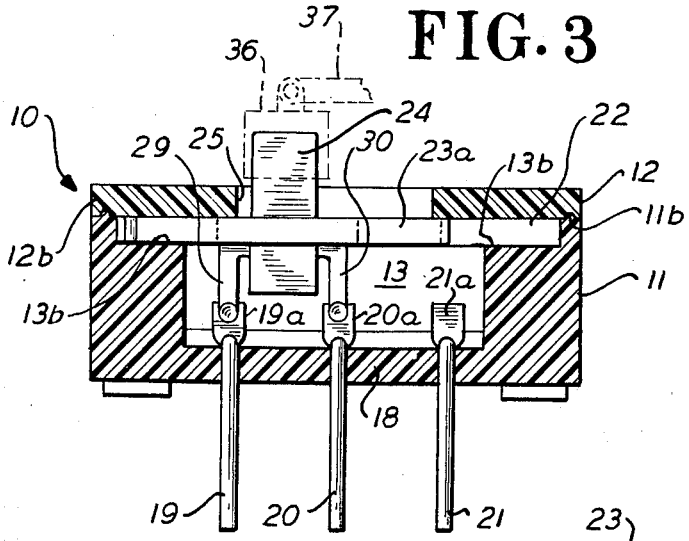
FIG. 3 is a vertical sectional view taken on the line 3—3 of FIG. 1.

An embodiment of the invention herein shown by way of illustrative example comprises an oblong housing 10 for each set of four identical single-pole switches, which has a shallow height relative to its length dimension. This housing comprises a body section 11 and a cover 12 each molded of an insulative plastic material. The body section has recessed edges 11*a* at the opposite longer sides thereof which receive respective flanges 12*a* of the cover (FIG. 2); and further, the confronting border portions of the body section and cover have interengaging tongues 11*b* and grooves 12*b* (FIG. 3) which further locate the cover on the body section. The cover is secured as by screws (not shown) or as by a suitable cement or ultrasonic bonding.

In the body section there are four oblong cavities 13, 14, 15 and 16 — one for each single-pole switch — which are parallel to opposite side walls of the housing and separated at a minimum spacing by intermediate walls 17 thereof. The upper part of each cavity is offset slightly into the side walls 17 and extended parallel with these walls beyond the cavity to provide narrow ledges 13*a* at the sides and elongate ledges 13*b* at the opposite ends. These ledges coact with the side walls 17 and cover 12 to provide a guideway 22 for each cavity which is rectangular in cross section (FIG. 2) and which traverses the cavity and extends to nearly the opposite end walls of the housing (FIG. 3) in parallel with the line of the respective contacts 19*a*–21*a*. Extending through the bottom wall 18 of each cavity is a set of three terminal pins 19, 20 and 21 adapted for plug-in connection with a printed circuit board. The terminal pins of each set are positioned midway the width of the cavity (FIG. 2) and are spaced equally from each other along the cavity (FIG. 3) to provide a central pole terminal 20 and outer contact terminals 19 and 21. These terminal pins project upwardly into the cavity and have the upper portions thereof swaged in line with each other to provide three fixed contacts 19*a*, 20*a* and 21*a* in the medial plane of the cavity lengthwise thereof.

Mounted slidably in each guideway is a switch-pole holder 23 of an oblong shape molded of suitable insulating plastic material. This holder has a rectangular body portion 23*a* of a length less than the length of the guideway 22 by at least the distance between the successive terminal pins, and has a clearance fit with the walls of the guideway so that it slides freely therealong. A button 24 on the upper part of the holder extends with clearance through an elongate slot 25 in the cover 12 to permit the holder to be shifted manually or by mechanical means between its switch positions. Depending from the central portion of the holder into the cavity are two spaced parallel lugs 26 (FIG. 4) adapted to receive therebetween in interlocking engagement therewith a one-piece switch pole 27 for connecting alternately the center terminal pin 20 to the outer terminal pins 19 and 21 as the switch button is shifted back and forth between respective "on" positions.

Figure 4:
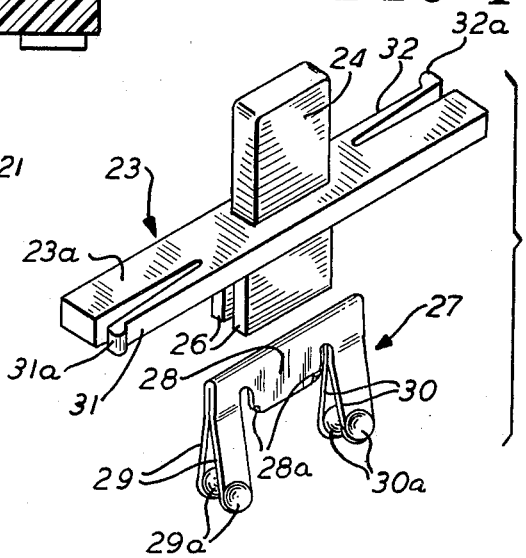
FIG. 4 is an exploded view of the switch-pole holder and of the switch-pole contact member mountable therein.
Figure 5:
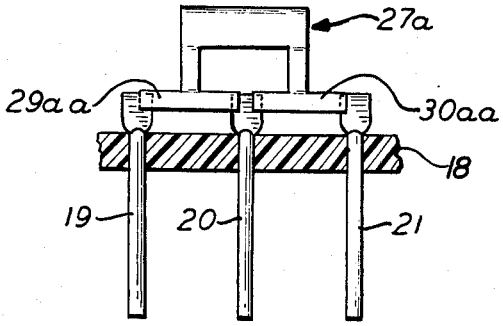
FIG. 5 is a fractional view of a modified embodiment showing a switch pole of a shorting type in a midposition relative to the terminal pins.

The switch pole 27 is of a one-piece construction comprising a preshaped plate blanked from a spring-tempered copper sheet and then bent into a U-form as shown in FIG. 4. This formed switch pole has a central portion 28 of a length greater than that of the lugs 26 and has pairs of switch blades 29 and 30 at the ends of the bridge portion depending therefrom in a V-arrangement. The lower end portions of the blades are embossed inwardly to form the same with hemispherical contact faces 29*a* and 30*a*. Alternatively, either the terminal pins or the switch blades may have side wings forming long contact faces, as 29*aa* and 30*aa*, for the blades of switch pole 27*a* shown in FIG. 5, to make the switch of a shorting type. The corner portions of the opposite legs of the bridge portion 28 are bent outwardly to form pointed projections 28*a* which, when the bridge portion is pressed between the lugs 26, will indent the inside walls of the lugs and secure the switch pole firmly to the holder.

The pairs of blades 29 and 30 of the switch pole 27 are separated from each other by the distance between successive terminal pins 19–21, and are located symmetrically relative to the plane of the fixed contacts 19*a*–21*a* and at the same level thereof so that when the switch button 24 is shifted to the left from a central position to an operated position the switch blades 29 and 30 will slidably embrace the fixed contacts 19*a* and 20*a* and when the button 24 is shifted to the right will slidably embrace respectively the fixed contacts 20*a* and 21*a*, thereby providing a double-throw action. Since each engagement of the blades with a fixed contact is an embracing one with a dual contact, the switch is rendered immune to shock and vibration, and is provided with a high current-carrying capacity and with a low contact resistance.

The switch-pole holder 23 is detented in its operated positions as well as in an intermediate open position by two integral resilient arms 31 and 32 formed in the molding of the holder at opposite ends and preferably also at opposite sides thereof (FIG. 4). These detent arms have rounded cam portions 31*a* and 32*a* at their ends which slide against the side walls 17 of the respective cavity. In each of these side walls there are three notches 33, 34 and 35 spaced by one-half the distance between the successive terminal pins 19–21 so that the detent arms will engage the outer notches when the switch is in its closed positions and will engage the central groove 34 when the switch is in an intermediate open position.

Whenever it is desired to operate two or more of the single-pole switches in unison, a channel-shaped bridge 36 (dottedly shown) may be pressed over the respective buttons 24 either for manual operation or by mechanical means as through a link 37 pivoted to the bridge 36.

By way of illustrative example, an 8-pole switch of the present construction will have an over-all length of 1 inch (2.54 cm), a width of 0.660 inch (1.67 cm), and a height of 0.350 inch(0.89 cm), not including the length of the terminal pins which themselves may typically be 3/16 inch (0.475 cm). The spacing between the terminal pins of each single-pole switch is 0.150 inch (0.381 cm), and the spacing between the terminal pins of adjacent switches is 0.100 inch (0.254 cm). The switches have been measured to have a contact resistance of less than 50 milliohms, a dielectric withstanding voltage of 1000 VRMS, and an insulation resistance greater than 10 thousand megohms. The force required to shift the contact button from its detented positions is approximately 1 ounce (28.4 grams). These measured specifications render the switch highly useful in the compact printed circuit field.

The embodiment of my invention herein particularly shown and described is intended to be illustrative and not necessarily limitative of my invention since the same is subject to changes and modifications without departure from the scope of my invention, which I endeavor to express according to the following claims.

I claim:

1. A miniature slide switch for integrated circuit systems comprising an insulating housing having a shallow height dimension relative to its length and a narrow cavity lengthwise of the housing for an individual single-pole switch, said switch comprising a plurality of terminal pins extending outwardly through the bottom wall of said cavity for plug-in connection with a printed circuit board and projecting into said cavity to provide a plurality of fixed contacts therein lengthwise of the housing, said cavity having also side recesses at the upper end thereof forming a rectangular guideway traversing the cavity parallel to the line of said contacts, an insulating pole-switch holder mounted slidably in said guideway for movement along said cavity, said holder having a slide-actuator button on its upper side extending through a clearance opening in an upper wall of said housing and having a pair of adjacent parallel stub-like lugs extending from its bottom side downwardly into said cavity, a switch pole having a central bridge portion secured to said holder in a wedged relationship between said lugs and having a pair of spring blades at each end depending from said bridge portion in an inverted V-arrangement, said blades having rounded inwardly-projecting contact faces at their lower ends in line with said terminal contacts and having a spacing therebetween the same as between adjacent terminal pins whereby upon shifting said holder slidably along said guideway into an "on" position said pairs of switch blades are cammed into embracing relation with a pair of said terminal contacts to interconnect the respective terminal pins, and upon shifting said holder from said "on" position said blades are disengaged from said contacts.

2. The miniature switch set forth in claim 1 comprising a row of three equally-spaced terminal pins at the bottom of said cavity in an in-line arrangement parallel with said guideway, wherein said switch pole is mounted centrally on said holder relative to its length dimension and said guideway extends axially past said cavity permitting said holder to be shifted in one direction into one "on" position to interconnect one pair of said terminal pins, and in the other direction into a second "on" position to interconnect the other pair of said terminal pins in a double-throw action.

3. A miniature multipole double-throw slide switch for integrated circuit systems comprising a housing having a shallow height dimension relative to its length and having a plurality of individual single-pole double-throw switches mounted therein in side-by-side arrangement, said housing having a plurality of parallel oblong cavities for said switches respectively and having respective guideways traversing the cavities at the top thereof and extending substantially past each cavity to approximately the opposite end walls of the housing, a plurality of terminal pins mounted in and extending through the bottom wall of each cavity at equal intervals in line with said guideway, said pins extending past the bottom of said housing for plug-in connection with a printed circuit board and extending into the cavity forming fixed contacts therein, a switch-pole holder mounted slidably in said guideway lengthwise thereof, said guideway extending beyond the sides of said cavities to form side ledges along the cavities to guide the holder when the same does not span the entire length of the cavity, a button on the top of each holder extending through a clearance opening in the cover of the housing, a pair of spaced stub-like lugs on the bottom of each holder depending within the respective cavity, and a switch pole in each cavity having a central bridge portion mounted on the holder between said lugs and having a pair of spring switch blades at each end depending from the bridge portion in a V-arrangement into the cavity, said pairs of blades being separated by the distance between successive terminal pins for embracing respectively successive pairs of said terminal pins to interconnect the same at successive "on" positions of said switch-pole holder and for disconnecting said terminal pins at an "off" position of the holder between said "on" positions.

* * * * *